US005275749A

United States Patent [19]

Kugel et al.

[11] Patent Number: 5,275,749

[45] Date of Patent: Jan. 4, 1994

[54] N-ACYL-N-HYDROCARBONOXYALKYL ASPARTIC ACID ESTERS AS CORROSION INHIBITORS

[75] Inventors: Robert L. Kugel, Norwalk; Werner J. Blank, Wilton, both of Conn.

[73] Assignee: King Industries, Inc., Norwalk, Conn.

[21] Appl. No.: 972,749

[22] Filed: Nov. 6, 1992

[51] Int. Cl.[5] ..... C10M 133/56; C10M 133/16

[52] U.S. Cl. ..... 252/51.5 R; 252/38; 252/46.6; 252/47

[58] Field of Search ..... 252/51.5

[56] References Cited

U.S. PATENT DOCUMENTS

| | | | |
|---|---|---|---|
| 3,687,852 | 8/1972 | Godfrey et al. | 252/77 |
| 3,957,854 | 5/1976 | Miller | 260/482 |
| 4,228,304 | 10/1980 | Noda et al. | 562/507 |
| 4,321,062 | 3/1982 | Herbstman et al. | 44/391 |
| 4,462,918 | 7/1984 | Matthews et al. | 252/51.5 R |
| 5,089,157 | 2/1992 | Trivett | 252/51.5 R |

FOREIGN PATENT DOCUMENTS

| | | |
|---|---|---|
| 0086513 | 1/1983 | European Pat. Off. . |
| 434464 | 6/1991 | European Pat. Off. . |
| 85014663 | 10/1985 | France . |
| 85014665 | 10/1985 | France . |
| 73030278 | 10/1973 | Italy . |
| 56-041388 | 4/1981 | Japan . |
| 02142760 | 5/1990 | Japan . |
| 9104952 | 4/1991 | PCT Int'l Appl. . |
| 777053 | 11/1980 | U.S.S.R. . |
| 810781 | 3/1981 | U.S.S.R. . |
| 924090 | 4/1982 | U.S.S.R. . |
| 960232 | 9/1982 | U.S.S.R. . |
| 1242507 | 7/1986 | U.S.S.R. . |

OTHER PUBLICATIONS

Mona Industries, Inc., Monacor 39 Brochure, Feb. 1990.

Chemical Abstract Registry No. 65626-32-6, (1977).

Chemical Abstract Registry No. 65626-29-1, (1977).

Chemical Abstract No. 103946-51-6, date unknown.

*Primary Examiner*—Ellen M. McAvoy

*Attorney, Agent, or Firm*—Hedman, Gibson & Costigan

[57] ABSTRACT

The invention relates to the lubricating compositions containing an N-acyl-N-alkoxyalkyl aspartate ester, optionally, in further combination with an anti-wear agent. The compositions exhibit corrosion inhibition and anti-wear properties, coupled with improved demulsibility.

38 Claims, No Drawings

N-ACYL-N-HYDROCARBONOXYALKYL ASPARTIC ACID ESTERS AS CORROSION INHIBITORS

FIELD OF THE INVENTION

This invention relates to lubricating oil compositions containing additives which exhibit corrosion inhibition, anti-wear properties and improved demulsibility.

BACKGROUND OF THE INVENTION

Amino acids and their derivatives have been described as corrosion inhibitors in lubricating oil compositions. For example, Japanese Patent 02142760 discloses the use of aqueous iron (II) aspartate salts as corrosion inhibitors for cast iron and Japanese Patent 6041388 deals with the use of a blend of acylated aspartic acid with lecithin as an oil soluble corrosion inhibitor. Similarly, Italian Patent 73-30278 describes aspartic acid amides as corrosion inhibitors in aqueous metal working systems and PCT application WO 91/04952 describes a metal salt of an aminocarboxylic acid as a corrosion inhibitor for use in coatings. U.S. Pat. No. 4,321,062 discloses the use of phenyl aspartates as corrosion inhibitors for gasoline and U.S. Pat. No. 4,228,304 teaches the use of aspartic acid derivatives of cyclohexanecarboxylic acid as anti-rust and emulsifying agents.

It is also known in the art that amino acids and their derivatives exhibit anti-wear properties or anti-wear synergy. For example Russian Patents 777053, 810781, 924090, 960232 and 1242507 teach the use of tetrasodium N-alkyl sulfosuccinoylaspartates to reduce tool wear. French Patent 85-14665 discloses overbased alkaline earth salts of amino acids as anti-wear detergent additives for lubricating oil, while European Patent 86513 (U.S. Pat. No. 4,462,918) discloses a lubricating oil composition with anti-wear properties or anti-wear synergy which contains a dialkyl ester of aminosuccinic acid of the formula

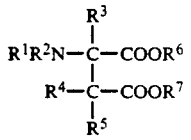

where $R^1$ and $R^2$ are hydrogen, a hydrocarbyl radical containing 1-30 carbon atoms or an acyl derivative of the hydrocarbyl radical containing 1-30 carbon atoms and $R^3$, $R^4$, $R^5$, $R^6$, and $R^7$ are hydrogen or hydrocarbyl radicals containing 1-30 carbon atoms and a Group II metal dithiophosphate.

Further, lubricating oil compositions containing amino acid derivatives with combined corrosion resistance and anti-wear properties are known in the art. French Patent No. 85-14663 describes a microdispersion, in oil, of metal salts of amino acids, including dicarboxylic amino acids which exhibit both anti-rust; and anti-wear properties. European Patent Application 0434464A1 teaches a lubricating oil composition containing an ashless sulfur and/or phosphorus anti-wear agent and an aminosuccinate ester corrosion inhibitor of the formula

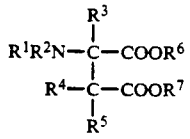

where at least one of $R^1$ or $R^2$ is an acyl group derived from a saturated or unsaturated carboxylic acid of up to 30 carbon atoms and the other can be hydrogen, an alkyl group of 1-30 carbon atoms or an acyl group derived from a saturated or unsaturated carboxylic acid of up to 30 carbon atoms, $R^3$, $R^4$, and $R^5$ are hydrogen or an alkyl of 1-4 carbon atoms, and $R^6$ and $R^7$ are alkyl groups of 1-30 carbon atoms.

N-acyl-N-hydrocarbonoxyalkyl aspartic acid ester compounds, which are not disclosed by the foregoing citations, are known in the art. For example, N-(3-carboxy-5-ethyl-1-oxononyl)-N-[3-(decyloxy)propyl]-,1,4-diethyl ester and N-(3-carboxy-5-ethyl-1-oxononyl)-N-]3-{(2-ethylhexyl)oxy}propyl]-,1,4-diethyl ester (Chemical Abstracts Registration Nos. 65626-32-6 and 65626-29-1) (Grenzflaechenakt. Stoffe, 4th, Teil 1) have been reported to be useful as nonfoaming and lye-resistant wetting agents. Similarly, N-acetyl-, 4-[2-hydroxy-3-{(1-oxooctadecyl)oxy}propyl] ester (Chemical Abstracts Registration No. 103946-51-6) (Arm. Khim. Zh., 41, (10), 603-9, 1988) has been reported to be useful as a surfactant. It has now been found that certain of such compounds are useful as corrosion inhibitors in lubricating oils and, unexpectedly, they possess the important advantage of acting as demulsifiers, a property not possessed or foreshadowed by their closely related analogs disclosed in the prior art lubricating compositions.

The term "demulsifier" as used in the present specification is intended to describe those compounds capable of preventing or retarding the formation of emulsions or capable of breaking emulsions. Demulsibilty is an important property in lubricating systems because condensation of atmospheric moisture often occurs on internal engine surfaces, especially on the interior of steam turbines as a result of temperature differentials. The normal action of an engine or turbine can beat the condensed moisture into an emulsion with the lubricating oil. The resulting emulsion has a reduced lubricity and consequently a reduced life as compared to the non-emulsified lubricating oil composition. Some common demulsifers are described in U.S. Pat. No. 3,957,854. Typically they comprise derivatives of ethylene oxide, such as ethoxylated or polyethoxylated organic mono-, di-, and triamines, ethoxylated carboxylic acid amides, ethoxylated quaternary ammonium salts, polyoxyalkylene alcohols and their ethers and esters, block polymers based on glycols, polyglycols, diamines or polyamines reacted sequentially with ethylene oxide or substituted ethylene oxides, and the esters and ethers of the described block polymers.

Dinonylnapthalene sulfonic acid and its metal salts form another important class of demulsifiers.

Demulsifiers typically function by changing the surface properties of the oil causing the emulsified water to coalesce. For example, in a steam turbine, the demulsifying agent in the lubricating oil causes the water to coalesce and settle in the sump from which it can be drawn off. Separation with a good demulsifier often occurs within 10-15 minutes, even if the oils contain zinc dialkyl dithiophosphates which tend to stabilize water in oil emulsions.

SUMMARY OF THE INVENTION

According to the present invention there are provided lubricating oil compositions comprising a major proportion of a lubrication oil and a minor, effective amount of an N-acyl-N-hydrocarbonoxyalkyl aspartic acid compound having the formula

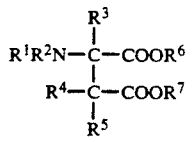

wherein $R^1$ is an hydrocarbonoxyalkyl group of from about 6 to about 30 carbon atoms, $R^2$ is a carboxyl substituted acyl group containing from about 1 to about 30 carbon atoms or such a group at least partially neutralized with an alkali metal base, an alkaline earth metal base, an amine or a mixture of any of the foregoing, and $R^3$, $R^4$, R, $R^6$ and $R^7$ are each independently selected from hydrogen or a hydrocarbon group of from about 1 to about 30 carbon atoms, alone or in further combination with an anti-wear agent. In a preferred embodiment the N-acyl-N-hydrocarbonoxyalkyl aspartic acid is a mono- or diester with the proviso $R^6$ and/or $R^7$ is a hydrocarbon group of from about 1 to about 30 carbon atoms. Such compositions exhibit improved demulsibility properties as well as anti-corrosion and anti-wear properties.

The preferred N-acyl-N-hydrocarbonoxyalkyl aspartic acid esters are N-acyl-N-hydrocarbonoxyalkyl aspartic acid esters where $R^1$ is a 3-($C_6$–$C_{18}$)hydrocarbonoxy($C_3$–$C_6$)alkyl group, most preferably selected from a cyclohexyloxypropyl, a 3-octyloxypropyl group, a 3-isooctyloxypropyl group, a 3-decyloxypropyl group, a 3-isodecyloxypropyl group, a 3-($C_{12}$–$C_{16}$)alkoxypropyl group or a combination of the foregoing, $R^2$ is a saturated or unsaturated carboxyl substituted acyl group of from about 2 to about 18 carbon atoms, or a carboxyl substituted acyl group of from about 2 to about 18 carbon atoms at least partially neutralized with an amine, an alkali metal base or an alkaline earth metal base. $R^2$ is a 3-carboxy-1-oxo-propyl group or a 3-carboxy-1-oxo-propyl group partially neutralized with an amine selected from 3-octyloxypropyl amine, 3-decyloxypropyl amine, 3-($C_{12}$–$C_{16}$)alkoxypropyl amine or a mixture of the foregoing, or 3-carboxy-1-oxo-2-dodecenylpropyl group or a 3-carboxy-1-oxo-2-dodecenylpropyl group partially neutralized with an amine selected from 3-octyloxypropyl amine, 3-decyloxypropyl amine, 3-($C_{12}$–$C_{16}$) alkoxypropyl amine, an alkali metal base, an alkaline earth metal base or a mixture of the foregoing. $R^3$, $R^4$ and $R^5$ are preferably hydrogen and $R^6$ and $R^7$ are the same or different alkyl groups of from about 3 to about 6 carbon atoms, most preferably are each a 2-methylpropyl group.

The anti-wear agent may be a Group II metal dithiophosphate, where the Group II metal is selected from Zn, Mg, Ca and Ba or a combination of any of them. Group II metal dithiophosphates are commercially available, or they can be made readily by means well known to those skilled in this art. Alkoxylated metal dithiophosphates as taught in the United Kingdom Patent No. 2,070,054 may also be used in preparing lubricating oil compositions according to the present invention.

Preferred anti-wear agents are organic dithiocarbamate esters, most preferably methylenebis(dibutyldithiocarbamate), organic phosphorothioate esters, and most preferably triphenyl phosphorothioate, and amine salts of phosphoric or alkylphosphonic acids.

The lubricating oil may be any mineral or non-mineral oil suitable for use as a lubricant. The lubricating oil may include paraffinic lubricating oil base stocks of mineral origin, synthetic oils such as polyalphaolefins, e.g. hydrogenated polydecene, synthetic lubricant esters, such as dialkyl adipates and azelates in which the alkyl groups typically have 1 to 20 carbon atoms each, for example, dioctyl azelate, dinonyl adipate or di-(2-ethyl-hexyl)azelate and oils of biological origin including more particularly lubricant vegetable oils such as rape seed oil, jojoba oil, cotton seed oil, peanut oil, or palm oil. The crude mineral oil may be prepared by means of physical separation methods, such as distillation, dewaxing and de-asphalting, or it may have been prepared by means of chemical conversion such as catalytic or non-catalytic hydrotreatment of mineral oil fractions, or by a combination of physical separation methods and chemical conversion, or it may be a synthetic hydrocarbon base oil.

The lubricating oil may also be thickened to from a grease by the addition of clays of the bentonite or hectorite type, of metal soaps of carboxylic acids such as stearic or 12-hydroxystearic acid, naphthenic acids, rosin oil or tall oil, where the metals are lithium, aluminum, Calcium, barium or sodium, or by addition of polyamides or polyureas.

The lubricating oil composition according to the present invention comprises preferably from about 0.01 to about 10.0 percent by weight of the N-acyl-N-hydrocarbonoxyalkyl aspartic acid ester, most preferably from about 0.1 to about 2.0 percent by weight N-acyl-N-hydrocarbonoxyalkyl aspartic acid ester.

The lubricating composition, optionally, may also include from about 0.01 to about 5.0 percent by weight of the aforementioned anti-wear agents, preferably from about 0.1 to about 1.5 percent by weight of anti-wear agent.

Other lubricating oil additives which are known in the art such as pour point depressants, VI-improvers like polymethacrylate, antioxidants and anti-foam agents which are normally silicone based may also be present in the lubricating compositions prepared according to the present invention in conventional amounts for their desired effects.

DETAILED DESCRIPTION OF THE INVENTION

The invention will now be illustrated with reference to the following Examples. All parts and percentages are by weight unless specifically stated otherwise.

EXAMPLE 1

An N-acyl-N-hydrocarbonoxyalkyl aspartic acid ester is prepared by adding 115 parts of 3-decyloxypropylamine (combining weight equals 230), dropwise over 2.5 hours to 120 parts of di-i-butyl maleate at 75° C. in a suitable reaction vessel. The mixture is stirred at 125° C. for 3 hours. Volatiles are vacuum stripped to a pot temperature of 125° C. at 3.5mm Hg pressure. The yield of the reddish mobile liquid is 96.5% theory, determined by non-aqueous titration with 0.5N HCL in an anhydrous isopropyl alcohol. The product is acylated in situ at 110° C. with 38.1 parts of succinic anhydride for 1 hour. This is then partially neutralized by reaction with 9.1 parts of 3-decyloxypropylamine to give a reddish brown viscous liquid.

The resulting N-acyl-N-hydrocarbonoxyalkyl aspartic acid ester is added to a severely solvent refined heavy paraffinic petroleum oil having a viscosity of approximately 110 SUS at 100° F. (Sunpar LW110, a product of Sun Refining and Marketing Co., Philadelphia, Pa., U.S.A.). The concentration of the partially neutralized N-acyl-N-hydrocarbonoxyalkyl aspartic acid ester in the oil is approximately 0.10%.

The resulting lubricating composition, made in accordance with the present invention is tested for anti-corrosion properties using ASTM test D665 Procedure B, the Standard Test Method for Rust-preventing Characteristics of Inhibited Mineral Oil in the Presence of Synthetic Sea Water. In this test, degreased polished steel spindles are stirred, fully immersed, at 60° C., in 300 ml of the lubricating composition. After 30 minutes, 30 ml of synthetic sea water is added. The spindles must be rust free after 24 hours to pass the test. The results of the test are reported in Table 1.

EXAMPLE 2

An N-acyl-N-hydrocarbonoxyalkyl aspartic acid ester is prepared by adding 432 parts of 3-octyloxypropyl/3-decyloxypropyl-amine dropwise over 1 hour to 480 parts of di-i-butyl maleate at 75° C. The amine is composed of approximately 1% hexyloxypropylamine, 59% octyloxypropylamine, 39% decyloxypropylamine and 1% dodecyloxypropylamine and has an approximate combining weight of 216. The mixture is stirred at 125° C. for 2 hours. The volatiles are removed by vacuum stripping to a pot temperature of 130° C. at 1.6 mm of Hg pressure to give a reddish brown mobile liquid. A portion of the product, 251.4 parts, is acylated with 46.2 parts of succinic anhydride at 125° C. for 1 hour. 25 parts of the acylated material is partially neutralized by adding 0.9 parts of 3-octyloxypropyl/3-decyloxypropylamine.

The resulting N-acyl-N-hydrocarbonoxyalkyl aspartic acid ester is added to a severely solvent refined heavy paraffinic petroleum oil as used in Example 1 and tested for anti-corrosion properties according to the procedure outlined in Example 1. The concentration of the N-acyl-N-hydrocarbonoxyalkyl aspartic acid ester in the oil is 0.10%. The results of the test are reported in Table 1.

EXAMPLE 3

An N-acyl-N-hydrocarbonoxyalkyl aspartic acid ester is prepared by adding 140 parts of a mixture of 3-($C_{12}$–$C_{16}$)alkoxypropylamines dropwise over 1 hour to 120 parts of di-i-butyl maleate at 80° C. The amine is composed of 1% decyloxypropylamine, 25% dodecyloxypropylamine, 38% tridecyloxypropylamine, 20% tetradecyloxypropylamine, 15% pentadecyloxypropylamine and 1% hexadecyloxypropylamine and has a combining weight of 280. The reaction mixture is held at 80° C. for 1 hour and then stirred at 125° C. for 2 hours. The volatiles are removed by vacuum stripping to a pot temperature of 125° C. at 1 mm Hg pressure. The yield is 75% theory as determined by the procedure of Example 1. The product is cooled to 100° C. and reacted in situ with 34.6 parts of succinic anhydride added over 1 hour, and then partially neutralized with 12.5 parts of 3-($C_{12}$–$C_{16}$)alkoxypropylamine to give a brownish viscous liquid.

The resulting N-acyl-N-hydrocarbonoxyalkyl aspartic acid ester is added to a severely solvent refined heavy paraffinic petroleum oil as used in Example 1 and tested for anti-corrosion properties according to the procedure outlined in Example 1. The concentration of the N-acyl-N-hydrocarbonoxyalkyl aspartic acid ester in the oil is 0.05%. The results of the test are reported in Table 1.

EXAMPLE 4

An N-acyl-N-hydrocarbonoxyalkyl aspartic acid ester is prepared by adding 145.5 parts of 3-tetradecyloxypropylamine dropwise over 1.5 hours to 120 parts of di-i-butyl maleate at 75° C. The amine has an approximate combining weight of 291. The reaction mixture is then stirred at 125° C. for 2 hours. The yield is 82.5% theory based upon the procedure outlined in Example 1. 38.3 parts of succinic anhydride are added in portions over 25 minutes at 105° C. The resulting mixture is stirred at 110° C. for 1 hour. The material is partially neutralized by adding 11.3 parts of 3-tetradecyloxypropylamine to the reaction mixture giving a brown viscous liquid.

The resulting N-acyl-N-hydrocarbonoxyalkyl aspartic acid ester is added to a severely solvent refined heavy paraffinic petroleum oil as used in Example 1 and tested for anti-corrosion properties according to the procedure outlined in Example 1. The concentration of the N-acyl-N-hydrocarbonoxyalkyl aspartic acid ester in the oil is 0.05%. The results of the test are reported in Table 1.

COMPARATIVE EXAMPLE 1

A severely solvent refined heavy paraffinic petroleum oil and having a viscosity of approximately 110 SUS at 100° F., as used in Example 1 is tested for anti-corrosion properties according to the procedure outlined in Example 1. The results of the test are reported in Table 1.

COMPARATIVE EXAMPLE 2

An N-acyl-N-alkylaspartate ester is prepared by adding 94.4 parts of laurylamine, dropwise over three hours, to 115.2 parts of di-i-butyl maleate at 100° C. The reaction mixture is stirred at 125° C. for 5 hours, and then is vacuum stripped to remove the volatiles. The yield is 88% theory based upon the procedure outlined in Example 1. The product is acylated with 40.9 parts of succinic anhydride which is added in portions at 100° C. The resulting mixture is stirred for 1 hour. The material is partially neutralized by the addition of 7.5 parts of laurylamine giving a brown viscous liquid.

The resulting N-acyl-N-alkylaspartate ester is added to a severely solvent refined heavy paraffinic petroleum oil as used in Example 1 and tested for anti-corrosion properties according to the procedure outlined in Example 1. The concentration of the N-acyl-N-alkylaspartate ester in the oil is 0.10%. The results of the test are reported in Table 1.

COMPARATIVE EXAMPLE 3

An N-acyl-N-alkylaspartate ester is prepared by adding 820 parts of oleyl amine dropwise over 3 hours to 693 parts of di-i-butyl maleate at 75° C. The resulting mixture is then stirred for 4 hours. After vacuum stripping to a pot temperature of 150° C. at 0.6 mm Hg pressure, the product is then stirred with 191.9 parts of succinic anhydride added in small portions over an hour at 100° C. The acylated product is then partially neutralized by the addition of 55.2 parts of oleyl amine, giving a reddish brown viscous liquid.

The resulting N-acyl-N-alkylaspartate ester is added to a severely solvent refined heavy paraffinic petroleum oil as used in Example 1 and tested for anti-corrosion properties according to the procedure outlined in Example 1. The concentration of the N-acyl-N-alkylaspartate ester in the oil is 0.05%. The results of the test are reported in Table 1.

COMPARATIVE EXAMPLE 4

Monacor 39 is a commercial ashless corrosion inhibitor available from Mona Industries, Paterson, N.J., and is described as an N-alkylaspartic acid diester. Monacor 39 is added to a severely solvent refined heavy paraffinic petroleum oil as used in Example 1 and tested for anti-corrosion properties according to the procedure outlined in Example 1. The concentration of the Monacor 39 additive in the oil is 0.10%. The test results are reported in Table 1.

TABLE 1

| COMPOSITION | % of ADDITIVE | ANTI-CORROSION TEST RESULT |
|---|---|---|
| EXAMPLE 1 | 0.10 | PASS |
| EXAMPLE 2 | 0.10 | PASS |
| EXAMPLE 3 | 0.05 | PASS |
| EXAMPLE 4 | 0.05 | PASS |
| COMPARATIVE EXAMPLE 1 | 0.00 | FAIL, 1 hr |
| COMPARATIVE EXAMPLE 2 | 0.10 | PASS |
| COMPARATIVE EXAMPLE 3 | 0.05 | PASS |
| COMPARATIVE EXAMPLE 4 | 0.10 | PASS |

These test results show that compositions prepared in accordance with the present invention, Examples 1–4, exhibit anti-corrosion properties.

EXAMPLE 5

An ashless lubricating composition, in accordance with the present invention, is prepared by mixing an N-acyl-N-hydrocarbonoxyalkyl aspartic acid ester as prepared in Example 1 with a hydrotreated heavy paraffinic petroleum distillate mixture having a viscosity of 154 SUS at 100° F (Exxon Co., Houston, Tex., Tradename Flexon 845), and containing 0.25 % of an alkylated diphenylamine antioxidant (Ciba-Geigy Corp., Hawthorne, N.Y., Tradename Irganox L57) a nd 1.0% of methylenebis(dibutyldithio-carbamate) (RT Vanderbuilt Co., Norwalk, Conn., Tradename Vanlube 7723), an ashless anti-wear agent. The concentration of the N-acyl-N-hydrocarbonoxyalkyl aspartic acid ester in the resulting lubricating composition is 0.25%. The anti-wear properties of the lubricating composition are determined using a Falex 4-ball EP machine, operating at 1800 rpm, with a load of 40 kg for 1 hour. The results of the test are reported in Table 2.

EXAMPLE 6

An ashless lubricating composition, in accordance with the present invention, is prepared by mixing an N-acyl-N-hydrocarbonoxyalkyl aspartic acid ester as prepared in Example 2 with Flexon 845 containing 0.25% Irganox L57 and 1.0% Vanlube 7723. The composition is tested for anti-wear properties according to the procedure outlined in Example 5. The concentration of the N-acyl-N-hydrocarbonoxyalkyl aspartic acid ester in the lubricating composition is 0.25%. The test results are reported in Table 2.

EXAMPLE 7

An ashless lubricating composition, in accordance with the present invention, is prepared by mixing an N-acyl-N-hydrocarbonoxyalkyl aspartic acid ester as prepared in Example 3 with Flexon 845 containing 0.25% Irganox L57 and 1.0% Vanlube 7723. The composition is tested for anti-wear properties according to the procedure outlined in Example 5. The concentration of the N-acyl-N-hydrocarbonoxyalkyl aspartic acid ester in the lubricating composition is 0.25%. The test results are reported in Table 2.

EXAMPLE 8

An ashless lubricating composition, in accordance with the present invention, is prepared by mixing an N-acyl-N-hydrocarbonoxyalkyl aspartic acid ester as prepared in Example 4 with Flexon 845 containing 0.25% Irganox L57 and 1.0% Vanlube 7723. The composition is tested for anti-wear properties according to the procedure as outlined in Example 5. The concentration of the N-acyl-N-hydrocarbonoxyalkyl aspartic acid ester in the lubricating composition is 0.25%. The test results are reported in Table 2.

COMPARATIVE EXAMPLE 5

The anti-wear properties of Flexon 845 containing 0.25% Irganox L57 and 1.0% Vanlube 7723 are determined according to the procedure outlined in Example 5. The results are reported in Table 2.

COMPARATIVE EXAMPLE 6

A lubricating composition, in accordance with the prior art, is prepared by mixing an N-acyl-N-alkylaspartate ester as prepared in Comparative Example 2 with Flexon 845 containing 0.25% Irganox L57 and 1.0% Vanlube 7723. The composition is tested for anti-wear properties according to the procedure outlined in Example 5. The concentration of the N-acyl-N-alkylaspartate ester in the lubricating composition is 0.25%. The results of the test are reported in Table 2.

COMPARATIVE EXAMPLE 7

A lubricating composition, in accordance with the prior art, is prepared by mixing an N-acyl-N-alkylaspartate ester as prepared in Comparative Example 3 with Flexon 845 containing 0.25% Irganox and 1.0% Vanlube 7723. The composition is tested for anti-wear properties according to the procedure outlined in Example 5. The concentration of the N-acyl-N-alkylaspartate ester in the lubricating composition is 0.25%. The test results are reported in Table 2.

EXAMPLE 8

A lubricating composition, in accordance with the prior art, is prepared by mixing Monacor 39 with Flexon 845 containing 0.25% Irganox and 1.0% Vanlube 7723. The composition is tested for anti-wear properties according to the procedure outlined in Example 5. The concentration of Monacor 39 in the lubricating composition is 0.25%. The results of the test are reported in Table 2.

TABLE 2

| COMPOSITION | WEAR SCAR (mm) |
|---|---|
| EXAMPLE 5 | 0.35 |
| EXAMPLE 6 | 0.39 |
| EXAMPLE 7 | 0.33 |
| EXAMPLE 8 | 0.32 |
| COMPARATIVE EXAMPLE 5 | 0.50 |
| COMPARATIVE EXAMPLE 6 | 0.36 |
| COMPARATIVE EXAMPLE 7 | 0.40 |
| COMPARATIVE EXAMPLE 8 | 0.36 |

EXAMPLE 9

An ashless lubricating composition, in accordance with the present invention, is prepared by mixing an N-acyl-N-hydrocarbonoxyalkyl aspartic acid ester as prepared in Example 2 with Flexon 845 containing 1.0% of triphenyl phosphorothionate (Ciba-Geigy Corp., Hawthorne, N.Y., Tradename Irgalube TPPT), an ashless anti-wear agent. The anti-wear properties of the lubricating composition are determined according to the procedures as outlined in Example 5. The concentration of the N-acyl-N-hydrocarbonoxyalkyl aspartic acid ester in the resulting lubricating composition is 0.25%. The results of the test are reported in Table 3.

COMPARATIVE EXAMPLE 9

The anti-wear properties of Flexon 845, containing 1.0% Irgalube TPPT, are determined according to the procedure outlined in Example 5. The test results are reported in Table 3.

COMPARATIVE EXAMPLE 10

A lubricating composition, in accordance with the prior art, is prepared by mixing Monacor 39 with Flexon 845 containing 1.0% Irgalube TPPT. The composition is tested for anti-wear properties according to the procedure outlined in Example 5. The concentration of Monacor 39 in the lubricating composition is 0.25%. The results of the test are reported in Table 3.

TABLE 3

| COMPOSITION | WEAR SCAR (mm) |
|---|---|
| EXAMPLE 9 | 0.20 |
| COMPARATIVE EXAMPLE 9 | 0.49 |
| COMPARATIVE EXAMPLE 10 | 0.21 |

These test results demonstrate that compositions prepared in accordance with the present invention, Examples 5–9, exhibit anti-wear properties.

Table 4 depicts the superior demulsibility properties possessed by lubricating compositions prepared in accordance with the present invention. The lubricating compositions reported in Table 4 comprise ISO 32 paraffinic oil containing 0.6% zinc dialkyldithiophosphate and varying amounts of demulsifiers/ anti-wear/ anti-corrosion additives. The demulsibility properties are measured according to ASTM test D1401. In this test 40 ml of distilled water and 40 ml of the lubricating composition are placed in a 100 ml graduated cylinder and are heated to 54° C. in a water bath. The oil and water phases are contacted by a paddle of standard dimensions and stirred at 1500 rpm for 5 minutes. The water is allowed to settle and the volumes of the oil, water and emulsion layers are measured at 5 minute intervals. The test is ended when the emulsion layers measure 3 ml or less. The time limit for water separation is usually set at 30 minutes.

The demulsifier/anti-wear/anti-corrosion additives to the lubricating compositions tested for demulsibility properties, reported in Table 4 are as follows:

Additive A—the N-acyl-N-hydrocarbonoxyalkyl aspartic acid ester prepared in Example 1;

Additive B—the N-acyl-N-hydrocarbonoxyalkyl aspartic acid ester prepared in Example 2 without partial neutralization;

Additive C—the N-acyl-N-hydrocarbonoxyalkyl aspartic acid ester prepared in Example 3;

Additive D—the N-acyl-N-hydrocarbonoxyalkyl aspartic acid ester prepared in Example 4;

Additive E—the N-acyl-N-alkylaspartate ester prepared in Comparative Example 2;

Additive F—the N-acyl-N-alkylaspartate ester prepared in Comparative Example 3;

Additive G—Monacor 39;

Additive H—Ca DNN Sulfonate.

TABLE 4

| | DEMULSIBILITY TEST | | | | | |
|---|---|---|---|---|---|---|
| | Additive | % Additive | Oil Volume | Water Volume | Emulsion Volume | Time |
| Example 10 | A | 1.0 | 37 | 40 | 3 | 15 |
| Example 11 | A | 0.5 | 40 | 38 | 2 | 5 |
| Example 12 | A | 0.25 | 40 | 40 | 0 | 10 |
| Example 13 | A | 0.1 | 42 | 37 | 1 | 25 |
| Example 14 | B | 1.0 | 37 | 38 | 3 | 45 |
| Example 15 | B | 0.5 | 38 | 40 | 2 | 10 |
| Example 16 | B | 0.25 | 41 | 39 | 0 | 10 |
| Example 17 | B | 0.1 | 42 | 38 | 0 | 20 |
| Example 18 | C | 1.0 | 39 | 38 | 3 | 20 |
| Example 19 | C | 0.5 | 40 | 40 | 0 | 10 |
| Example 20 | C | 0.25 | 42 | 38 | 0 | 30 |
| Example 21 | C | 0.1 | 40 | 40 | 0 | 40 |
| Example 22 | D | 1.0 | 38 | 40 | 2 | 15 |
| Example 23 | D | 0.5 | 42 | 38 | 0 | 10 |
| Example 24 | D | 0.25 | 41 | 37 | 2 | 20 |
| Example 25 | D | 0.1 | 42 | 35 | 3 | 35 |
| Comparative Example 11 | | | 40 | 39 | 1 | 40 |
| Comparative Example 12 | E | 1.0 | 39' | 40 | 1 | 15 |
| Comparative Example 13 | E | 0.5 | 40 | 37 | 3 | 30 |
| Comparative Example 14 | E | 0.25 | 40 | 40 | 0 | 20 |
| Comparative Example 15 | E | 0.1 | 40 | 40 | 0 | 20 |
| Comparative Example 16 | F | 1.0 | 39 | 38 | 3 | 25 |
| Comparative Example 17 | F | 0.5 | 39 | 38 | 3 | 30 |
| Comparative Example 18 | F | 0.25 | 40 | 37 | 3 | 40 |
| Comparative Example 19 | F | 0.1 | 41 | 37 | 2 | 25 |
| Comparative Example 20 | G | 1.0 | 36 | 35 | 9 | 50 |
| Comparative Example 21 | G | 0.5 | 37 | 37 | 6 | 60 |
| Comparative Example 22 | G | 0.25 | 37 | 18 | 25 | 50 |
| Comparative Example 23 | G | 0.1 | 41 | 38 | 1 | 45 |
| Comparative Example 24 | H | 1.0 | 40 | 38 | 2 | 10 |
| Comparative Example 25 | H | 0.5 | 40 | 40 | 0 | 10 |
| Comparative Example 26 | H | 0.25 | 40 | 38 | 2 | 5 |
| Comparative Example 27 | H | 0.1 | 42 | 38 | 0 | 25 |

These results show that Examples 9–25, which are lubricating compositions prepared according to the present invention, exhibit excellent demulsifying properties as shown by the low separation times. The separation times for Examples 10–25 are much shorter than the separation times for Comparative Examples 12–23 which are lubricating compositions prepared with N-acyl-N-alkylaspartate esters, as taught in the prior art. The separation times for Examples 10–25 are comparable to Comparative Examples 24–27 which are lubricating compositions containing a well known sulfonate demulsifier.

EXAMPLE 28

The lithium salt of an N-acyl-N-hydrocarbonoxyalkyl aspartic acid ester is prepared by mixing 264.2 parts of the di-i-butyl ester of N-(1-oxo-3-carboxypropyl)-N-isodecyloxypropyl aspartic acid with 50 ml of heptane and 14.5 parts of lithium hydroxide monohydrate. The mixture is heated at reflux temperature for 2 hours. Water is removed by azeotropic distillation and, after filtration, the brown viscous oil is stripped under vacuum to 125° C. The product is analyzed by HCl titration and contains 76.2% of the aforementioned lithium salt.

EXAMPLE 29

The barium salt of an N-acyl-N-hydrocarbonoxyalkyl aspartic acid ester is prepared by mixing 500 parts of the di-i-butyl ester of N-(1-oxo-3-carboxypropyl)-N-isodecyloxypropyl aspartic acid with 100 ml of heptane and 25 parts of water and heating to 50° C. Barium hydroxide monohydrate is added in five portions of 13.0 parts each, over one hour. After removing water and heptane by azeotropic distillation, the brown oil is titrated with HCl and contains 88.9% of the barium salt.

EXAMPLE 30

The potassium salt of an N-acyl-N-hydrocarbonoxyalkyl aspartic acid ester is prepared by mixing 500 parts of the di-i-butyl ester of N-(1-oxo-3-carboxypropyl)-N-isodecyloxypropyl aspartic acid with 100 ml of heptane and heating to 50° C. A solution of potassium hydroxide is prepared by dissolving 45.5 parts in approximately 100 ml of solution and is added dropwise over one hour to the mixture. Water and heptane are removed by azeotropic distillation. The viscous brown liquid had a base number of 102 mg KOH/gm.

EXAMPLE 31

A lubricating composition, in accordance with the present invention, is prepared by mixing an N-acyl-N-hydrocarbonoxyalkyl aspartic acid ester salt, as prepared in Example 28, with NLGI #2+ lithium 12 OH stearate grease (Witco Corporation, LubriMatic Division, Olathe, Kans., U.S.A.). The concentration of N-acyl-N-hydrocarbonoxyalkyl aspartic acid ester salt in the lubricating composition is 0.25%.

The resulting lubricating composition, made in accordance with the present invention, is tested for anti-corrosion properties using ASTM Test D1743, the Standard Test Method for Corrosion Preventing Properties of Lubricating Greases. In this test, new, cleaned Timkin roller bearings are packed with the grease to be tested and are then run under a light load for 60 seconds to distribute the grease in a pattern that might be found in service. The bearings are exposed to deionized water and are then stored for 48 hours at 52+/− 1° C. and 100% relative humidity. After cleaning, the bearing cups are examined for evidence of corrosion. The criterion for failure is the presence of any corrosion spot 1.0 mm or longer in the longest dimension. Samples are rated as pass or fail. The test results are reported in Table 5.

EXAMPLE 32

A lubricating composition, in accordance with the present invention, is prepared by mixing an N-acyl-N-hydrocarbonoxyalkyl aspartic acid ester salt, as prepared in Example 29, with NGLI #2+ lithium 12 OH stearate grease (Witco Corporation, LubriMatic Division, Olathe, Kans., U.S.A.). The concentration of N-acyl-N-hydrocarbonoxyalkyl aspartic acid ester salt in the lubricating composition is 0.25%.

The resulting lubricating composition, made in accordance with the present invention, is tested for anti-corrosion properties according to the procedure as outlined in Example 31. The test results are reported in Table 5.

EXAMPLE 33

A lubricating composition, in accordance with the present invention, is prepared by mixing an N-acyl-N-hydrocarbonoxyalkyl aspartic acid ester salt, as prepared in Example 30, with NGLI #2+ lithium 12 OH stearate grease (Witco Corporation, LubriMatic Decision, Olathe, Kans., U.S.A.). The concentration of N-acyl-N-hydrocarbonoxyalkyl aspartic acid ester salt in the lubricating composition is 0.25%.

The resulting lubricating composition, made in accordance with the present invention, is tested for anti-corrosion properties according the procedure as outlined in Example 31. The test results are reported in Table 5.

TABLE 5

| GREASE RUST TEST | |
|---|---|
| EXAMPLE | RATING |
| 31 | Pass |
| 32 | Pass |
| 33 | Pass |

The data clearly show that lubricating compositions prepared according to the present invention exhibit improved demulsifying properties when the alkyl groups on the aspartic acid ester are replaced by alkoxyalkyl groups. This is surprising because the prior art also indicates that alkoxyalkyl-substituted aspartic acid esters have utility as lye-resistant wetting agents and as surfactants, as mentioned above.

The above mentioned patents, publications, and test methods are incorporated herein by reference.

Many variations in the present invention will suggest themselves to those skilled in this art in light of the above, detailed description. All such obvious modifications are within the full intended scope of the appended claims.

We claim:

1. A lubricating oil composition comprising a major proportion of a lubricating oil and from about 0.01 to about 10.0 percent by weight of an N-acyl-N-hydrocarbonoxyalkyl aspartic acid compound having the formula

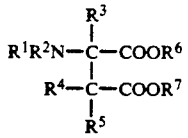

wherein $R^1$ is a hydrocarbonoxyalkyl group of from about 6 to about 30 carbon atoms, $R^2$ is a carboxyl substituted acyl group containing from about 2 to about 30 carbon atoms, or such a group at least partially neutralized with an alkali metal base, an alkaline earth metal base, an amine or a mixture of any of the foregoing, and $R^3$, $R^4$, $R^5$, $R^6$, and $R^7$ are each, independently, selected from hydrogen or a hydrocarbon group of from about 1 to about 30 carbon atoms.

2. A composition as defined in claim 1 which also includes from about 0.1 to about 5 percent by weight of an anti-wear agent.

3. A composition as defined in claim 1 wherein $R^1$ is a $(C_6-C_{18})$hydrocarbonoxy$(C_3-C_6)$alkyl group.

4. A composition as defined in claim 3 wherein $R^1$ is selected from a cyclohexyloxypropyl, a 3-octyloxypropyl group, a 3-isooctyloxypropyl group, a 3-decyloxypropyl group, a 3-isodecyloxypropyl group, a 3-$(C_{12}-C_{16})$alkoxypropyl group, or a combination of any of the foregoing.

5. A composition as defined in claim 4 wherein $R^1$ is a 3-cyclohexyloxypropyl group.

6. A composition as defined in claim 4 wherein $R^1$ is a 3-isodecyloxypropyl group.

7. A composition as defined in claim 1 wherein $R^2$ is a saturated or unsaturated carboxyl substituted acyl group of from about 2 to about 18 carbon atoms, or carboxyl substituted acyl group of from about 2 to about 18 carbon atoms at least partially neutralized with an amine, an alkali metal base or an alkaline earth metal base.

8. A composition as defined in claim 7 wherein $R^2$ is a 3-carboxy-1-oxo-propyl group, or a 3-carboxy-1-oxo-propyl group partially neutralized with an amine selected from 3-octyloxypropyl amine, 3-decyloxypropyl amine, 3-$(C_{12}-C_{16})$ alkoxypropyl amine, an alkali metal base, an alkaline earth metal base or a mixture of any of the foregoing.

9. A composition as defined in claim 8 wherein the alkali metal base is lithium hydroxide, sodium hydroxide, potassium hydroxide, barium hydroxide or a mixture of any of the foregoing.

10. A composition as defined in claim 7 wherein $R^2$ is a 3-carboxy-1-oxo-2-dodecenylpropyl group, or a 3-carboxy-1-oxo-2-dodecenylpropyl group partially neutralized with an amine selected from 3-octyloxypropyl amine, 3-decyloxypropyl amine, 3-$(C_{12}-C_{16})$ alkoxypropyl amine, an alkali metal base, an alkaline earth metal base or a mixture of any of the foregoing.

11. A composition as defined in claim 10 wherein the alkali metal base is lithium hydroxide, sodium hydroxide, potassium hydroxide, barium hydroxide or a mixture of any of the foregoing.

12. A composition as defined in claim 1 wherein $R^3$, $R^4$, and $R^5$ are hydrogen.

13. A composition as defined in claim 1 wherein $R^6$ and $R^7$ are the same or different alkyl groups each of from about 3 to about 6 carbon atoms.

14. A composition as defined in claim 13 wherein $R^6$ and $R^7$ are each 2-methylpropyl groups.

15. A composition as defined in claim 1 wherein $R^6$ and $R^7$ are each 2-methylpropyl groups, $R^3$, $R^4$, and $R^5$ are each hydrogen, R is selected from a 3-octyloxypropyl group, a 3-decyloxypropyl group, a 3-tetradecyloxypropyl group, a 3-$(C_{12}-C_{16})$ alkyloxypropyl group, or a combination thereof, and $R^2$ is a 3-carboxy-1-oxo-propyl group.

16. A composition as defined in claim 1 wherein $R^6$ and $R^7$ are each 2-methylpropyl groups, $R^3$, $R^4$, and $R^5$ are each hydrogen, $R^1$ is selected from a 3-isodecyloxypropyl group, and $R^2$ is a 3-carboxy-1-oxo-propyl group.

17. A composition as defined in claim 2 wherein the anti-wear agent is a Group II metal dialkyl dithiophosphate in which the metal is selected from Zn, Mg, Ca, and Ba or a combination of any of them.

18. A composition as defined in claim 2 wherein the anti-wear agent is an alkylenebis(dithiocarbamate).

19. A composition as defined in claim 2 wherein the anti-wear agent is triphenyl phosphorothionate.

20. A composition as defined in claim 1 wherein the lubricating composition comprises about 0.1 to about 1.5 percent by weight of the N-acyl-N-hydrocarbonoxyalkyl aspartic acid compound.

21. A lubricating oil composition which is ashless, said composition comprising a major proportion of a lubricating oil and from about 0.01 to about 10.0 percent by weight of an N-acyl-N-hydrocarbonoxyalkyl aspartic acid mono- or diester having the formula

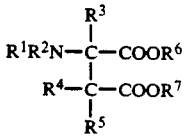

wherein $R^1$ is a hydrocarbonoxyalkyl group of from about 6 to about 30 carbon atoms, $R^2$ is a carboxyl-substituted acyl group containing from about 2 to about 30 carbon atoms or such a group at least partially neutralized with an amine, and $R^3$, $R^4$, $R^5$, $R^6$, and $R^7$ are each, independently, selected from hydrogen or a hydrocarbon group of from about 1 to about 30 carbon atoms, with the proviso that at least one of $R^6$ and $R^7$ is a hydrocarbon group of from about 1 to about 30 carbon atoms.

22. A composition as defined in claim 21 which also includes from about 0.1 to about 5 percent by weight of an anti-wear agent.

23. A composition as defined in claim 21 wherein $R^1$ is a $(C_6-C_{18})$hydrocarbonoxy$(C_3-C_6)$alkyl group.

24. A composition as defined in claim 23 wherein $R^1$ is selected from a 3-cyclohexyloxypropyl group, a 3-octyloxypropyl group, 3-isooctyloxypropyl group, a 3-decyloxypropyl group, a 3-isodecyloxypropyl group, a 3-$(C_{12}-C_{16})$alkoxypropyl group, or a combination of any of the foregoing.

25. A composition as defined in claim 24 wherein $R^1$ is a combination of a 3-octyloxypropyl group and a 3-decyloxypropyl group, a 3-octyloxypropyl group and a 3-tetradecyloxypropyl group, or a 3-decyloxypropyl group, and a 3-$(C_{12}-C_{16})$alkoxypropyl group.

26. A composition as defined in claim 21 wherein $R^2$ is a carboxyl-substituted saturated or unsaturated acyl group of from about 2 to about 18 carbon atoms, optionally at least partially neutralized with an amine.

27. A composition as defined in claim 26 wherein $R^2$ is a 3-carboxy-1-oxo-propyl group or a 3-carboxy-1-oxo-propyl group partially neutralized with an amine selected from 3-octyloxypropyl amine, 3-decyloxypropyl amine, 3-($C_{12}$–$C_{16}$) alkoxypropyl amine or a mixture of any of the foregoing.

28. A composition as defined in claim 21 wherein $R^3$, $R^4$, and $R^5$ are hydrogen.

29. A composition as defined in claim 21 wherein $R^6$ and $R^7$ are the same or different alkyl groups each of from about 3 to about 6 carbon atoms.

30. A composition as defined in claim 29 wherein $R^6$ and $R^7$ are each 2-methylpropyl groups.

31. A composition as defined in claim 21 wherein $R^6$ and $R^7$ are each 2-methylpropyl groups, $R^3$, $R^4$, and $R^5$ are each hydrogen, $R^1$ is selected from a 3-octyloxypropyl group, a 3-decyloxypropyl group, a 3-isodecyloxypropyl group, a 3-tetradecyloxypropyl group, a 3-($C_{12}$–$C_{16}$) alkyloxypropyl group, or a combination thereof, and $R^2$ is a 3-carboxy-1-oxo-propyl group.

32. A composition as defined in claim 22 wherein the anti-wear agent is an alkylenebis(dithiocarbamate).

33. A composition as defined in claim 22 wherein the anti-wear agent is triphenyl phosphorothionate.

34. A composition as defined in claim 21 wherein lubricating composition comprises about 0.1 to about 1.5 percent by weight of the N-acyl-N-hydrocarbonoxyalkyl aspartic acid mono- or diester.

35. A lubricating oil composition which is ashless and easily demulsifiable, said composition comprising a major proportion of a lubricating oil; from about 0.1 to about 5.0 percent by weight of an ashless dithiocarbamate or phosphorothionate anti-wear agent in combination with from about 0.01 to about 10.0 percent by weight of an N-acyl-N-hydrocarbonoxyalkyl aspartic acid mono- or diester anti-corrosion agent having the formula

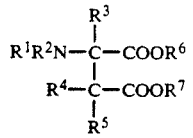

wherein $R^1$ is a hydrocarbonoxyalkyl group of from about 6 to about 30 carbon atoms, $R^2$ is an acyl group containing from about 2 to about 30 carbon atoms, and $R^3$, $R^4$, $R^5$, $R^6$, and $R^7$ are each, independently, selected from hydrogen or a hydrocarbon group of from about 1 to about 30 carbon atoms, with the proviso that at least one of $R^6$ and $R^7$ is a hydrocarbon group of from about 1 to about 30 carbon atoms, said composition providing a significantly lower wear rate between metal surfaces than the corresponding composition containing the anti-wear agent alone at the same concentration.

36. A lubricating oil composition which is ashless and easily demulsifiable, said composition comprising a major proportion of a lubricating oil; from about 0.1 to about 5.0 percent by weight of an ashless anti-wear agent selected from the group consisting of methylenebis(dibutyldithiocarbamate) and triphenyl phosphorothioate in combination with from about 0.01 to about 10.0 percent 10.0 percent by weight of an N-acyl-N-hydrocarbonoxyalkyl aspartic acid diester anticorrosion agent having the formula

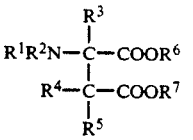

$R^1$ is selected from a 3-octyloxypropyl group, a 3-decyloxypropyl group, a 3-isodecyloxypropyl group, a 3-tetradecyloxypropyl group, a 3-($C_{12}$–$C_{16}$)alkoxypropyl group or a combination thereof, $R^2$ is a 3-carboxy-1-oxo-propyl group, $R^3$, $r^4$ and $R^5$ are each hydrogen and $R^6$ and $R^7$ are each 2-methylpropyl groups.

37. A composition as defined in claim 36 wherein the concentration of the N-acyl-N-hydrocarbonoxyalkyl aspartic acid diester anti-corrosion agent is from about 0.1 to about 1.0 percent by weight.

38. A composition as defined in claim 37 wherein the concentration of the N-acyl-N-hydrocarbonoxyalkyl aspartic acid diester anti-corrosion agent is from about 0.25 to about 1.0 percent by weight.

* * * * *